US009193197B2

(12) United States Patent
Kawamichi et al.

(10) Patent No.: US 9,193,197 B2
(45) Date of Patent: Nov. 24, 2015

(54) LIQUID DROPLET DETECTING DEVICE, INKJET RECORDING DEVICE INCORPORATING SAME, AND LIQUID DROPLET DETECTION METHOD

(71) Applicants: Genichiro Kawamichi, Ibaraki (JP); Shigeru Morinaga, Kanagawa (JP); Hideharu Miki, Ibaraki (JP); Hiroshi Ando, Ibaraki (JP); Kahei Nakamura, Tokyo (JP); Kazuhiro Akatsu, Ibaraki (JP); Hirotaka Kobayashi, Ibaraki (JP); Keiichi Watanabe, Ibaraki (JP)

(72) Inventors: Genichiro Kawamichi, Ibaraki (JP); Shigeru Morinaga, Kanagawa (JP); Hideharu Miki, Ibaraki (JP); Hiroshi Ando, Ibaraki (JP); Kahei Nakamura, Tokyo (JP); Kazuhiro Akatsu, Ibaraki (JP); Hirotaka Kobayashi, Ibaraki (JP); Keiichi Watanabe, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/620,005

(22) Filed: Feb. 11, 2015

(65) Prior Publication Data

US 2015/0224802 A1 Aug. 13, 2015

(30) Foreign Application Priority Data

Feb. 12, 2014 (JP) ..... 2014-024086
Nov. 28, 2014 (JP) ..... 2014-241398

(51) Int. Cl.
*B41J 29/393* (2006.01)
*B41J 2/21* (2006.01)

(52) U.S. Cl.
CPC ..... *B41J 29/393* (2013.01); *B41J 2/2142* (2013.01)

(58) Field of Classification Search
CPC .... B41J 29/393; B41J 2/2142; B41J 2/16579; B41J 2/2146; B41J 2/0451; B41J 2/04561; B41J 2029/3935; B41J 2/2139; B41J 2202/17; B41J 2/165; B41J 2/07; B41J 2/14153; B41J 2/515
USPC ..... 347/14, 16, 19, 78, 81, 101, 104, 105
See application file for complete search history.

(56) References Cited

U.S. PATENT DOCUMENTS 6,659,584 B2 * 12/2003 Miura et al. ..... 347/19
2012/0223991 A1 9/2012 Ono

FOREIGN PATENT DOCUMENTS

JP 2006-110964 4/2006
JP 2012-183654 9/2012

* cited by examiner

*Primary Examiner* — Thinh Nguyen
(74) *Attorney, Agent, or Firm* — Duft Bornsen & Fettig LLP

(57) ABSTRACT

A liquid droplet detecting device includes nozzles arranged in a paper width direction orthogonal to a paper conveying direction to discharge liquid droplets, a light emitting element provided on one side of the paper width direction to emit a light beam for liquid droplet detection, a light receiving element provided on the other side of the paper width direction to receive the light beam, a storage in which correspondence information on each of the nozzles and a scan position of the light beam when discharge of a liquid droplet from each of the nozzles is detected is stored, a controller to allow the light beam to scan according to the correspondence information, and a detector to determine presence or absence a liquid droplet discharged from each nozzle from an output of the light receiving element.

9 Claims, 15 Drawing Sheets

LIQUID DROPLET DETECTING DEVICE, INKJET RECORDING DEVICE INCORPORATING SAME, AND LIQUID DROPLET DETECTION METHOD

CROSS REFERENCE TO RELATED APPLICATION

The present application is based on and claims priority from Japanese Patent Application No. 2014-24086, filed on Feb. 12, 2014 and No. 2014-241398, filed on Nov. 28, 2014, the disclosure of which is hereby incorporated by reference in its entirety.

BACKGROUND OF THE INVENTION

1. Field of the Invention

The present invention relates to a liquid droplet detecting device, an inkjet recording device incorporating such a device and a liquid droplet detection method.

2. Description of the Related Art

An inkjet recording device to form an image on a paper by discharging ink from nozzles of recording heads is known. Nozzle discharge failure may occur in this device due to dried ink or entry of foreign matter and air bubbles.

Such nozzle discharge failure results in deteriorating image quality. In view of this, there is a known inkjet recording device with a liquid droplet detector which determines presence or absence of ink droplets from nozzles of a recording head by emitting a light beam to ink droplets from the nozzles and receiving scattered light by the droplets in a light traveling direction.

Another known inkjet recording device is a line inkjet printer in which recording heads having nozzles are arranged on a straight line along a paper width to discharge liquid droplets from the nozzles, aiming for improving image quality and increasing printing speed.

A known line inkjet printer comprises light emitting elements arranged in a paper conveying direction to emit light beams, to detect liquid droplets from nozzle lines arranged both in a paper width direction and the paper conveying direction orthogonal to the paper width direction.

In this printer the light emitting elements to emit light beams and light receiving elements to receive scattered light of the light beams are arranged separately with a distance corresponding to a paper width. Because of this, this printer is likely to be affected by reflected light and diffracted light so that it is difficult to accurately detect scattered light.

Moreover, an error in the optical axes of the light emitting elements and light receiving elements is large since both of the elements are separated. In view of this, a technique has been developed for detecting ink droplets at a proper position by decreasing the size of light beams, enhancing drive outputs of the light emitting elements and moving the light emitting elements in a paper conveying direction.

It is possible to detect liquid droplets at a proper position by moving the light emitting elements. However, there may be an error in the nozzle arrangement in the recording heads and an error in the directions in which ink droplets are discharged. To check presence or absence of a liquid droplet for all the nozzles by turns, it is necessary to reciprocate the light emitting elements in accordance with the positions of the nozzles to emit the light beams in a reciprocative manner in the paper conveying direction.

Along with a repetition of reciprocated scanning, an error in the stop positions of the light emitting elements will occur, causing target liquid droplets to be outside in the detection width of the light beam. Accordingly, an offset between a detected liquid droplet and a nozzle discharging this liquid droplet will occur. This problem can be dealt with by emitting light beams obliquely relative to the arrangement of the nozzles to reduce the errors in the stop positions of the light emitting elements and in the droplet discharge direction and moving the light emitting elements in one direction.

However, there is a drawback in the oblique light emission that the number of liquid droplets in the detection width of the light beam is decreased. This increases the moving area of the light emitting elements and requires a large amount of time for the liquid droplet detection.

In particular, an inkjet recording device used for printing high-speed continuous stationary comprises fixed recording heads for the purpose of printing total print area along a paper width at a certain resolution at high speed. The paper width is as large as 21 inches.

For example, for printing on a paper 21 inches wide at a recording density of 600 DPI, 12,600 nozzles per line are needed in the paper width direction.

Thus, this type inkjet recording device requires an enormous amount of time to detect liquid droplets from all of the nozzles by a light emission with the number of droplets in the detection width of the light beam decreased.

Further, a light emitting element unit and a light receiving element unit have to be individually mounted in the recording head unit. Therefore, it is difficult to position the light emitting elements and light receiving elements oppositely with a mounting error taken into account.

Furthermore, Japanese Laid-open Patent Application Publication No. 2006-110964 discloses a technique to concurrently detect ink droplets discharged from nozzles from a change in outputs of a received light beam by obliquely emitting a light beam relative to nozzle arrangement so as not to overlap ink droplets in a cross section of received light and controlling timing at which the ink droplets are discharged. This device can shorten time for determining presence or absence of discharged ink droplets.

SUMMARY OF THE INVENTION

The present invention aims to provide a liquid droplet detecting device which can quickly and accurately determine presence or absence of liquid droplets discharged from nozzles.

According to one embodiment, a liquid droplet detecting device comprises nozzles arranged in a paper width direction orthogonal to a paper conveying direction to discharge liquid droplets, a light emitting element provided on one side of the paper width direction to emit a light beam for liquid droplet detection, a light receiving element provided on the other side of the paper width direction to receive the light beam, a storage in which correspondence information on each of the nozzles and a scan position of the light beam when discharge of a liquid droplet from each of the nozzles is detected is stored, a controller to allow the light beam to scan according to the correspondence information, and a detector to determine presence or absence a liquid droplet discharged from each nozzle from an output of the light receiving element.

BRIEF DESCRIPTION OF THE DRAWINGS

Features, embodiments, and advantages of the present invention will become apparent from the following detailed description with reference to the accompanying drawings.

DETAILED DESCRIPTION OF THE PREFERRED EMBODIMENTS

Hereinafter, embodiments of an inkjet recording device and a liquid droplet detecting device will be described in detail with reference to the accompanying drawings. Wherever possible, the same reference numbers will be used throughout the drawings to refer to the same or like parts.

Figure 1:
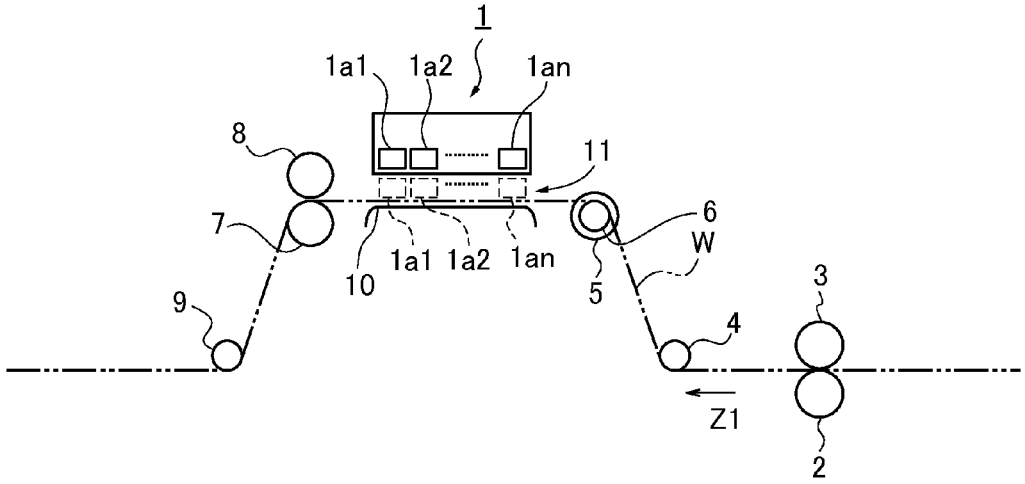
FIG. 1 schematically shows the structure of an inkjet recording device according to one embodiment.

FIG. 1 schematically shows the structure of an inkjet recording device according to one embodiment. The inkjet recording device is also called as an image forming device or an inkjet printer.

In FIG. 1 the inkjet recording device comprises an inkjet head array 1, a paper feeding roller 2, a driven roller 3 rotated with the paper feeding roller 2, a tension roller 4, a driven roller 6 including an encoder 5 for detecting a feed amount of a paper W, a paper ejection roller 7, a driven roller 8 rotated with the paper ejection roller 7, and a tension roller 9 arranged in a paper conveying direction Z1. The paper ejection roller 7 is rotated by a not-shown drive motor.

A drive plate 10 is provided between the driven roller 6 and the paper ejection roller 7 to guide the paper W. The inkjet head array 1 is disposed opposite to the drive plate 10, placing the paper W in-between.

The inkjet head array 1 includes inkjet heads 1*a*1, 1*a*2, . . . , 1*an* as recording heads arranged in the paper conveying direction. Nozzles are arranged in each of the inkjet head 1*a*1, 1*a*2, . . . , 1*an* in a paper width direction orthogonal to the paper conveying direction Z1.

The paper W is conveyed by the paper ejection roller 7 and driven roller 8 to a downstream of the paper conveying direction, receives liquid droplets for printing when crossing the drive plate 10, and is ejected. In the present embodiment the encoder 5 is attached to the driven roller 6, however, it can be provided on the driven roller 8.

Herein, paper W refers to not only a paper material but also a medium including thread, fiber, cloth, skin, metal, plastic, glass, wood, ceramic and an OHP sheet, and it is a general term for materials onto which ink as liquid droplets is attached.

Further, print or printing and image formation refer to not only generating texts or graphics on the paper W but also forming an image as a meaningless pattern, blowing liquid droplets onto the paper W, and creating a three-dimensional cubic object by blowing liquid droplets on the paper W. Also, the term, ink is used as a general term for recording liquid, fixing solution, resin and the like.

Structure of Liquid Droplet Detecting Device

Figure 2:
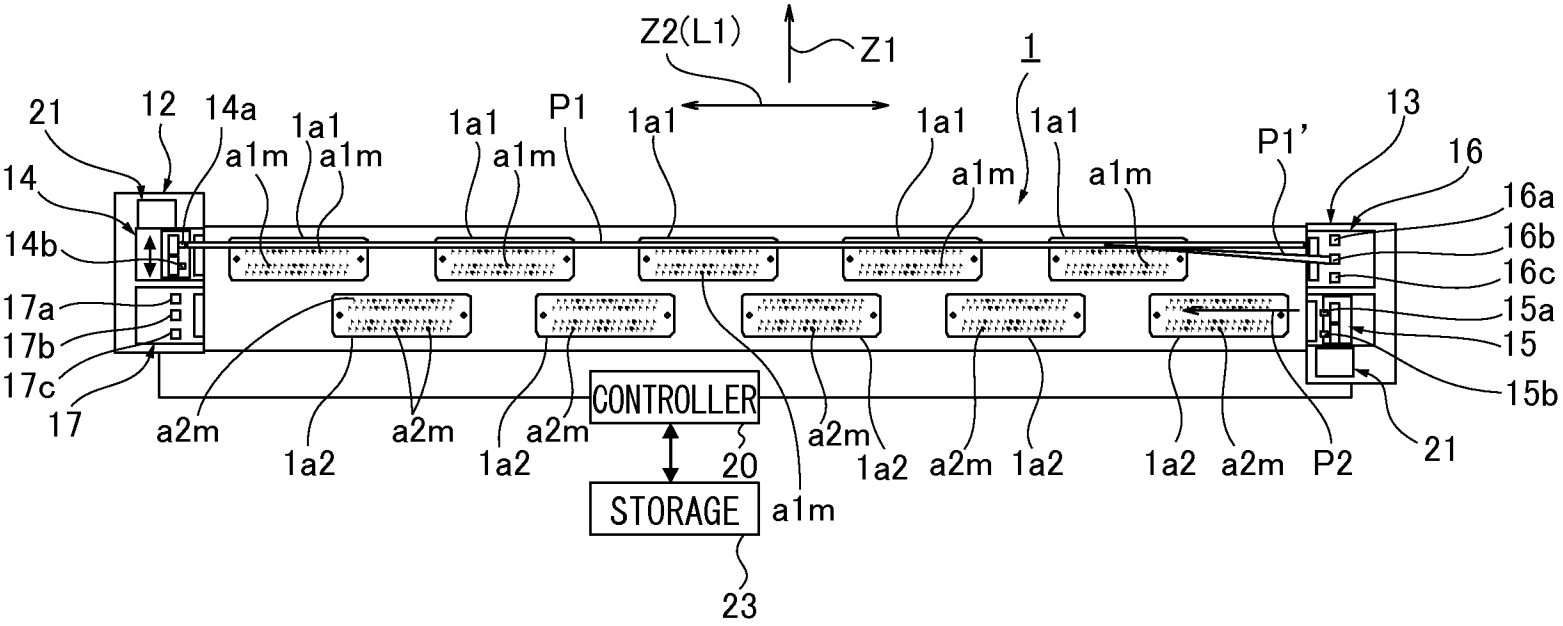
FIG. 2 is a plan view of a liquid droplet detecting device according to one embodiment.

FIG. 2 shows a positional relation between a liquid droplet detecting device 11 and the inkjet heads 1*a*1, 1*a*2, . . . , 1*an*. The liquid droplet detecting device 11 is disposed between the inkjet head array 1 and drive plate 10.

In FIG. 2 the number of the inkjet heads 1*a*1, 1*a*2, . . . , 1*an* is two in the paper conveying direction Z1 and five in a paper width direction Z2 orthogonal to the paper conveying direction Z1 by way of example.

The inkjet heads 1*a*1, 1*a*2 are provided with an interval in the paper width direction Z2. A large number of nozzles a1*m*, a2*m* are arranged in each of the inkjet heads 1*a*1, 1*a*2 in the paper width direction Z2.

For example, for printing on a paper W 21 inches wide at a density 600 DPI, 12,600 nozzles per line are placed along the width of the paper W. Herein, four nozzles a1*m* and four nozzles a2*m* are provided in the paper conveying direction in each of the inkjet heads 1*a*1, 1*a*2.

In FIG. 2 the nozzles a1*m*, a2*m* are arranged in a direction L1. Detector units 12, 13 are provided at both ends of the inkjet head array in the paper width direction to be able to reciprocate in the paper conveying direction Z1 for detecting a liquid droplet discharged from each of the nozzles a1*m*, a2*m* of the inkjet heads 1*a*1, 1*a*2.

The detector unit 12 includes a light emitting element 14 to emit a light beam P1 from one side to the other side in the paper width direction and a light receiving element 17 to receive a light beam P2 emitted from the other side of the paper width direction.

The detector unit 13 includes a light emitting element 15 to emit the light beam P2 from the other side to one side in the paper width direction and a light receiving element 16 to receive a light beam P1 emitted from the one side of the paper width direction. The detector units 12, 13 are controlled by a controller 20 and driven by a driver 21.

Figure 3:
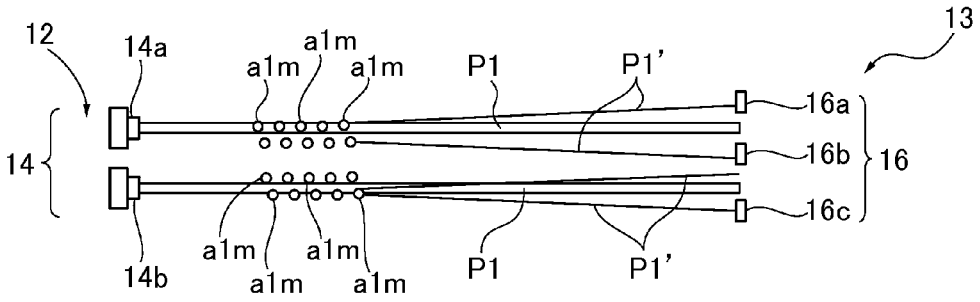
FIG. 3 is an enlarged view of a part of light emitting elements and light receiving elements in FIG. 2.

Referring to an enlarged view of FIG. 3, the light emitting element 14 comprises laser diodes (LD) 14*a*, 14*b*. The laser diode 14*a* is used to detect two of the four nozzle lines arranged orthogonally to the paper conveying direction Z1 and the laser diode 14*b* is used to detect the other two nozzle lines. The light emitting element 15 in FIG. 2 comprises laser diodes 15*a*, 15*b* functioning same as the laser diode 14*a*, 14*b*.

A light receiving element 16 comprises three photodiodes 16*a* to 16*c* and a light receiving element 17 comprises three phtodiodes 17*a* to 17*c*. The photodiode 16*b* is configured to be able to receive scattered light P1' from a liquid droplet in any direction, although the light may be scattered in various directions due to a tilt of the light emitting element 14 and an error in the positions of the nozzles a1*m*.

Moreover, the photodiode 16*b* receives both the scattered light P1' of the light beam P1 from the laser diode 14*a* and that from the laser diode 14*b*. The light receiving element 17 is configured same as the light receiving element 16.

Adjustment of Tilt Angle of Detector Units 12, 13

Figure 11A:
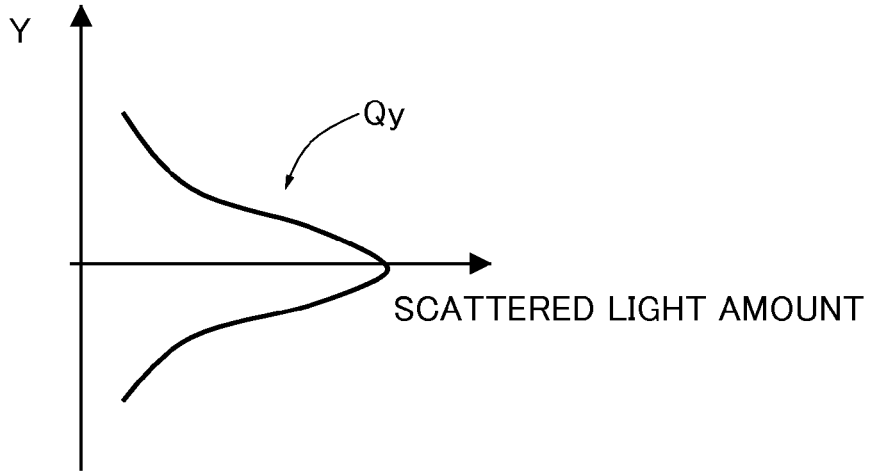
FIG. 11A shows an optical intensity distribution of scattered light amount by an offset of the position of a light beam relative to a forward scattering light receiving element and FIG. 11B shows an optical intensity distribution of offset light amount by the same.
Figure 11B:
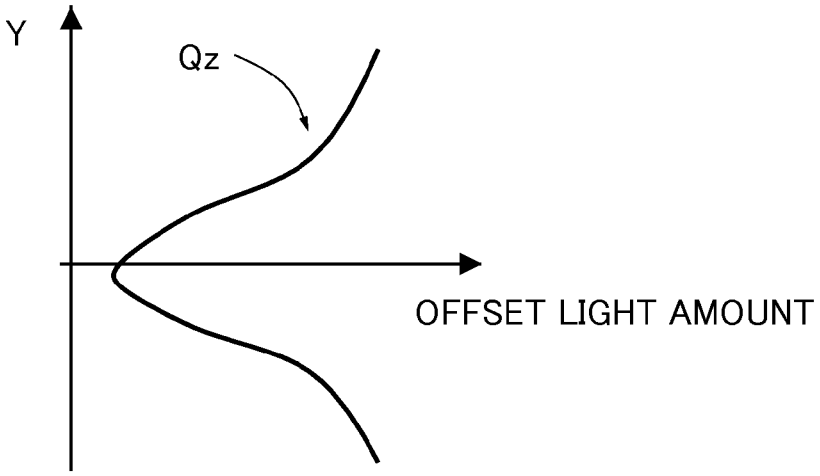

FIGS. 11A, 11B show the intensity distributions of offset light and scattered light of the light beam P1 at positions of the light emitting element 16 (photodiodes 16*a*, 16*b*) in ink discharge direction Y.

In forward scattering it is preferable that the photodiodes 16*a*, 16*b* receive a large amount of scattered light as shown in FIG. 11A and a small amount of offset light as shown in FIG. 11B, for the purpose of improving the accuracy at which liquid droplets are detected. To achieve this, an offset between the light beam P1 and the photodiodes 16*a*, 16*b* in the discharge direction Y should be set to be preferably small.

Figure 12:
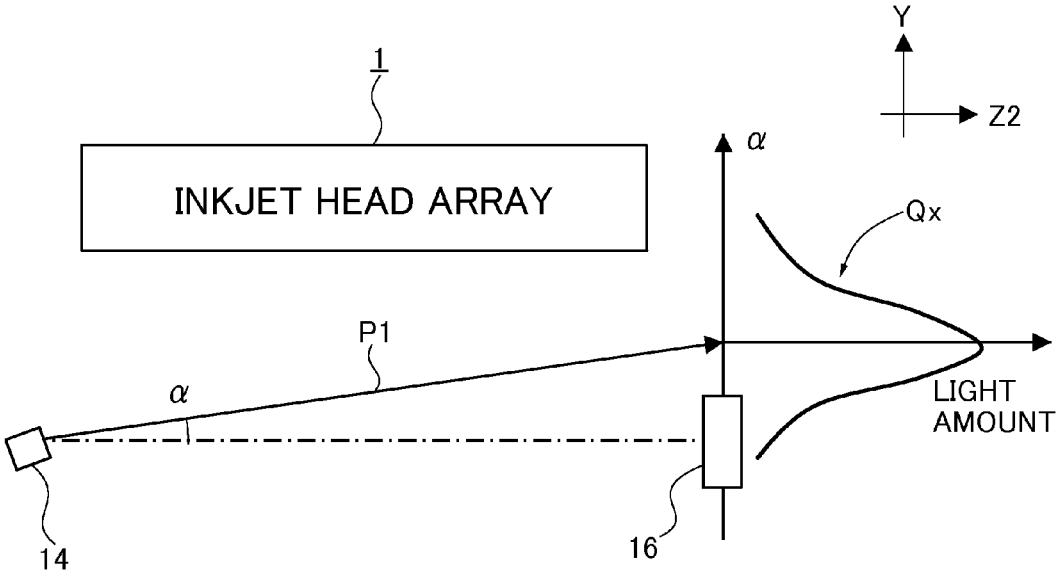
FIG. 12 shows a light-receiving amount of a light receiving element when a light emitting element before tilt adjustment of the detector unit emits a direct light beam to the light receiving element.

In mounting the detector units 12 and 13 on the inkjet head array 1, because of processing errors in the inkjet head array 1 and detector units 12 and 13 and a variation in assembly accuracy, the light beam P1 and light receiving element 16 (photodiodes 16*a*, 16*b*) may be shifted from the discharge direction Y, as shown in FIG. 12.

Thus, it is necessary to adjust the angle α of the detector units 12, 13 (angle α of the laser diodes 14*a*, 14*b* relative to the discharge direction) relative to the inkjet head array 1 when the detector units 12, 13 are mounted on the inkjet head array 1.

FIGS. 11A, 11B show intensity distributions Qy, Qz of the scattered light and offset light, respectively. FIG. 12 shows intensity distribution Qx of direct light and a relation between the light emitting element 14 of the detector unit 12 and the light receiving element 16 of the detector unit 13 relative to the inkjet head array 1.

The angle α of the laser diodes 14*a*, 14*b* relative to the discharge direction is adjusted while the intensity distribution of direct light Qx is monitored, by way of example. The structure and operation of a tilt adjusting mechanism are described referring to FIG. 13 to FIG. 21.

The inkjet head array 1 is comprised of a base plate 24 on which the inkjet head 1*a*1, 1*a*2, . . . , 1*an* are arranged and a pair of side plates 25 bent at a right angle relative to the base plate 24. FIG. 13 to FIG. 20 show only one of the side plates 25.

Referring to FIG. 15 to FIG. 20, the detector units 12 and 13 are rotatably attached to the side plates 25 via a hinge 26. The hinge 26 includes plates 26*a*, 26*b* and a rotational shaft 26*c*.

Figure 16:
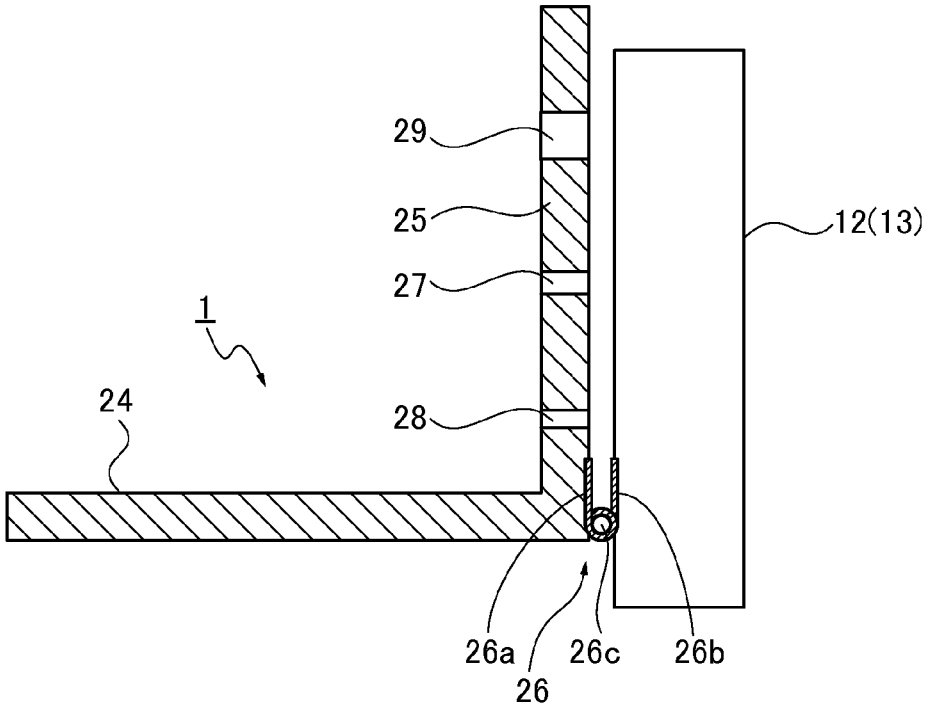
FIG. 16 is a side view of the detector unit rotatably attached to the inkjet head array.

Two screw holes 27, 28 are formed in each side plate 25 with an interval as shown in FIG. 16. A through hole 29 for a spindle of a later-described micrometer is formed right above the screw hole 27. The detector units 12, 13 each include two screw holes corresponding to the screw holes 27, 28.

Figure 17:
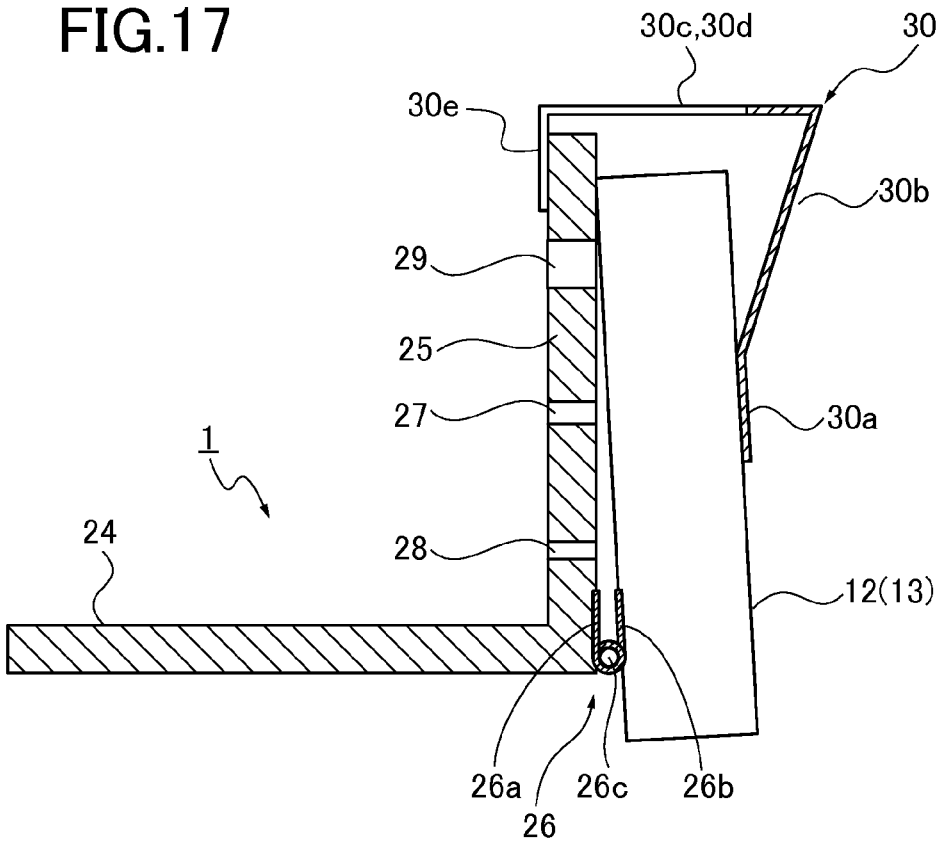
FIG. 17 is a side view of the detector unit pressed onto the inkjet head array in FIG. 16 by a blade spring.

First, the detector unit 12 (13) is rotatably attached to the inkjet head array 1 via the hinge 26 in FIG. 16 and pressed thereon by a force of a blade spring 30 in FIG. 17.

Figure 13:
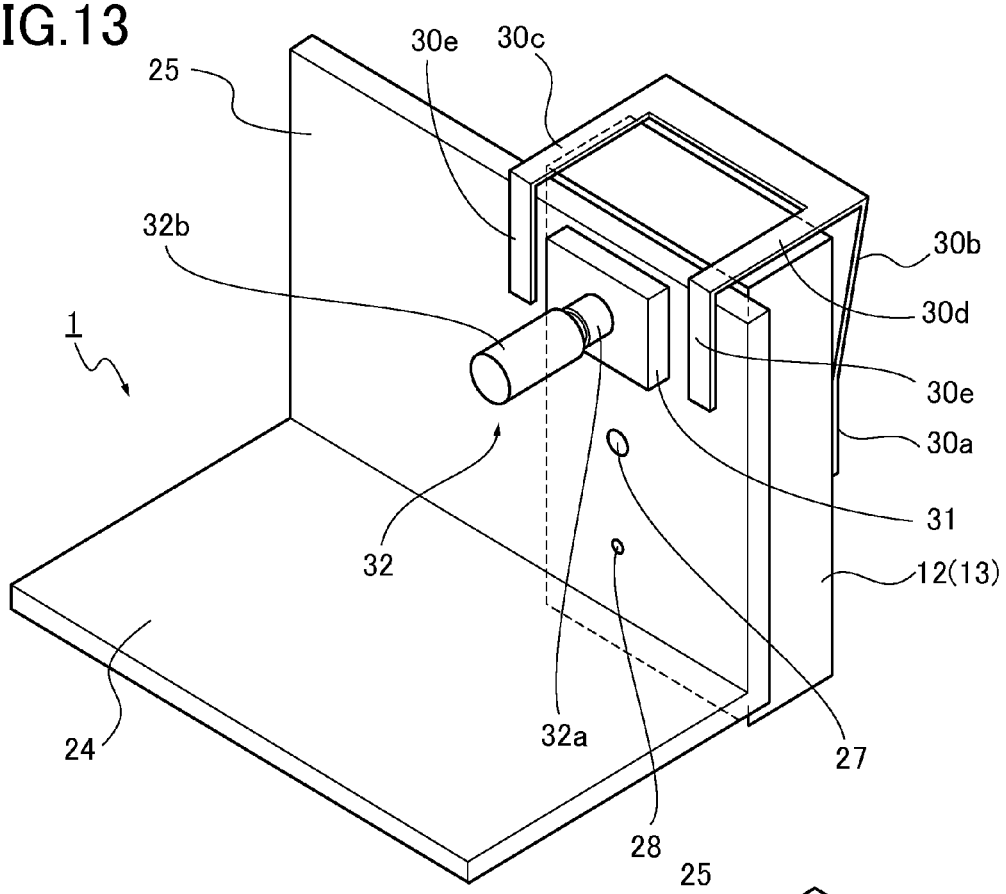
FIG. 13 is a perspective view of the detector unit as seen from the inkjet head array in FIG. 1.
Figure 14:
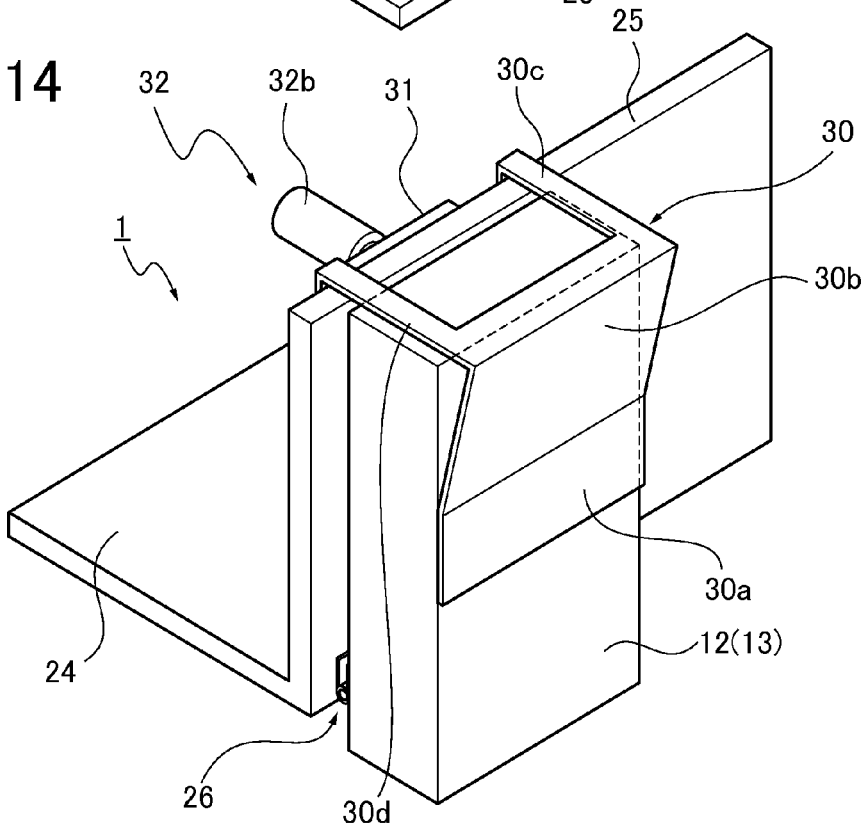
FIG. 14 is a perspective view of the inkjet head array as seen from the detector unit.

The blade spring 30 is comprised of a contact plate 30*a* to abut with the detector unit 12 (13), a slant plate 30*b* to accumulate a spring force, and a pair of arms 30*c*, 30*d*, as shown in FIG. 13, FIG. 14.

The pair of arms 30*c*, 30*d* each has a latch 30*e* to fasten the side plate 25. Thereby, the blade spring 30 is detachable from the inkjet head array 1 and the detector unit 12 (13).

The detector unit 12 (13) is pressed onto the side plate 25 of the inkjet head array 1 by the blade spring 30 around the shaft 26*c*. As a result, the detector unit 12 (13) is tilted relative to the side plate 25 in FIG. 17.

In place of the blade spring 30, the detector unit 12 (13) can be pressed onto the side plate 25 by use of an elastic member such as a rubber band.

A tilt adjusting mechanism to finely adjust a tilt angle of the detector unit 12 (13) is attached to the side plate 25. Referring to FIGS. 13 and 14, it is comprised of a micrometer 32 and a plate 31 to define parallelism to the side plate 25. The tilt adjusting mechanism is detachable from the side plate 25.

Figure 18:
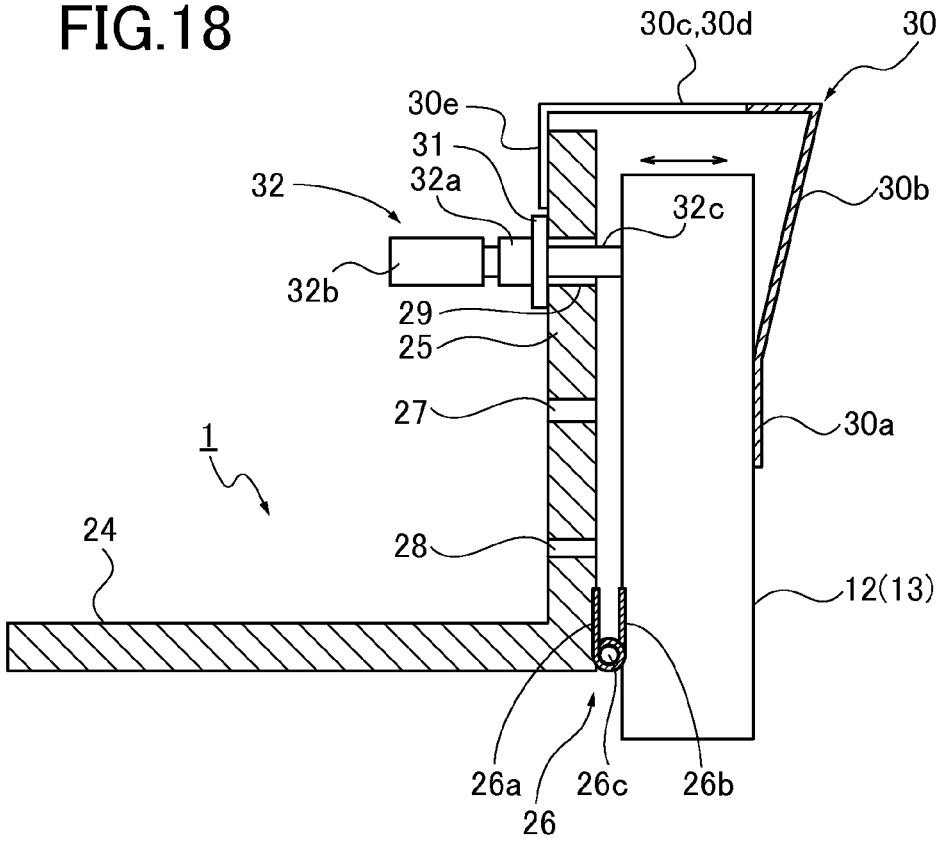
FIG. 18 is a side view of the detector unit pressed by a tip end of a micrometer for fine tilt adjustment attached to the inkjet head array in FIG. 17.

Referring to FIG. 13, the micrometer 32 comprises a sleeve 32*a*, a rotary portion 32*b*, and a spindle 32*c* (FIG. 18). The sleeve 32*a* and plate 31 are integrally formed in the present embodiment.

The sleeve 32*a* is calibrated. An operator rotates the rotary portion 32*b* to adjust a projection of the spindle 32*c* while visually checking the scale. Thereby, the operator can finely adjust a tilt of the detector unit 12 (13) relative to the side plate 25 in FIG. 18.

Next, the tilt adjustment of the detector unit 12 is described in detail. The detector unit 12 in FIG. 2 comprises the light emitting element 14 with the laser diodes 14*a*, 14*b* and the light receiving element 17 with the photodiodes 17*a* to 17*c*.

Likewise, the detector unit 13 in FIG. 2 comprises the light emitting element 15 with the laser diodes 15*a*, 15*b* and the light receiving element 16 with the photodiodes 16*a* to 16*c*.

Assumed that the light emitting element 14 is tilted in a reference position at an angle α relative to the direction Z2 orthogonal to the light receiving element 16 as shown in FIG. 12. The light intensity distribution QX of light including the direct light along the angle α and offset light is shown in FIG. 12.

When the light emitting element 14 is tilted at the angle α and the light receiving element 16 is at a reference position in FIG. 12, the amount of direct light incident on the light receiving element 16 corresponds to a low portion of the intensity distribution QX.

The adjustment of the detector unit 12 when the light emitting element 14 is tilted at the angle because of the tilt angle of the detector unit 12 relative to the side plate 25 is described with reference to FIG. 21.

First, it is determined that the laser diodes 14*a*, 14*b* and the photodiodes 16*a*, 16*b* are in the respective reference positions in step S31. In step S32 the controller 20 controls the laser diodes 14*a*, 14*b* to emit light beams.

In step S33 the controller 20 moves the laser diodes 14*a*, 14*b* or the photodiodes 16*a*, 16*b* from the reference positions and store the light receiving amounts of the photodiodes 16*a*, 16*b* and their positions.

In step S34 the controller 20 moves the laser diodes 14*a*, 14*b* to positions from the reference positions such that the photodiodes 16*a*, 16*b* receive the maximal amounts of light.

An operator adjusts the tilt of the detector unit 12 or laser diodes 14*a*, 14*b* relative to the side plates 25 to maximize the light receiving amounts of the photodiodes 16*a*, 16*b* while visually checking a screen in step S35, for example. The tilt of the laser diodes 14*a*, 14*b* is now adjusted.

The tilt adjustment in step S35 is performed by rotating the micrometer 32 in FIG. 18. The tip end of the spindle 32*c* of the micrometer 32 in rotation is pressed onto the detector unit 12 (13) to rotate the detector unit 12 (13) about the rotational shaft 26*c*.

This bends the blade spring 30 and the blade spring 30 accumulates a force to rotate the detector unit 12 (13) oppositely to the pressing of the spindle 32*c*.

Figure 19:
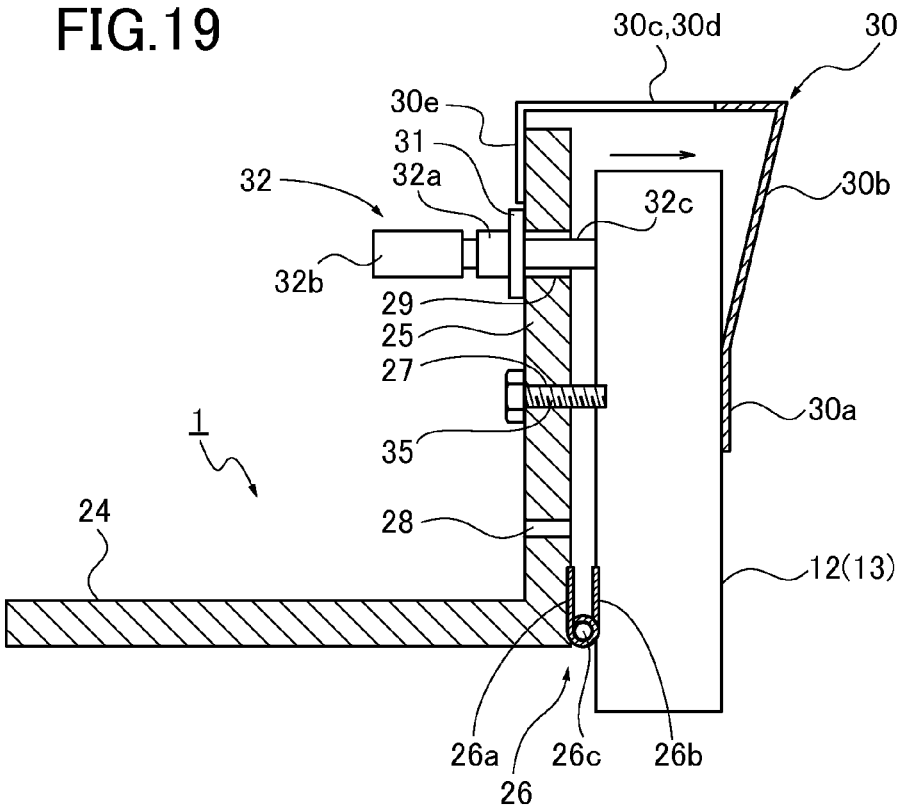
FIG. 19 is a side view of the inkjet head array and detector unit into which a drawing screw is inserted in place of the micrometer in FIG. 18 after the adjustment of the detector unit.

After the tilt adjustment of the detector unit 12 (13) with the micrometer 32, a drawing screw 35 shown in FIG. 19 is inserted into the screw hole 27 to fix the side plate 25 and detector unit 12 (13) together.

The drawing screw 35 replaces the blade spring 30 when the blade spring 30 is detached.

The drawing screw 35 rather than a set screw is used because the detector unit 12 (13) may be pressed by the set screw to be separated from the tip end of the spindle 32*c* of the micrometer 32. This causes a trouble in the tilt adjustment.

By use of the drawing screw 35 to join the detector unit 12 and the side plate 25, the posture of the detector unit 12 (13) relative to the side plate 25 can be maintained.

Figure 20:
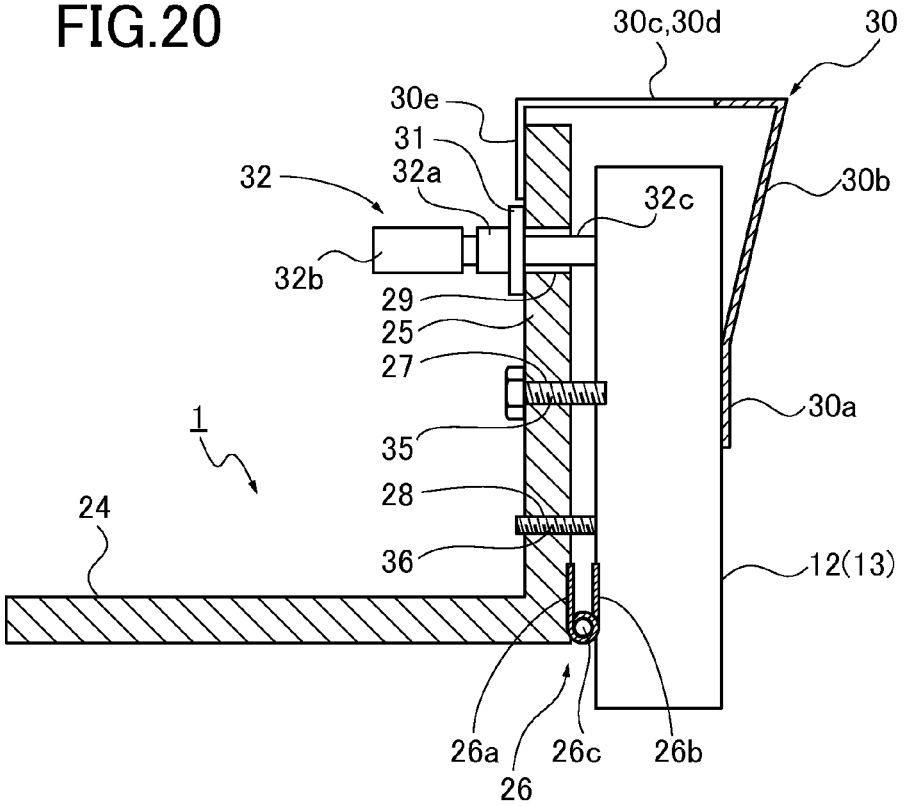
FIG. 20 is a side view of the assembled inkjet head array and detector unit into which a hexagon socket setscrew is fitted when the micrometer is removed, to prevent the detector unit from tilting towards the inkjet head array by a bias force of the blade screw.

Then, a hexagon socket setscrew 36 in FIG. 20 is fitted into the screw hole 28 while the side plate 25 and the detector unit 12 (13) are joined via the drawing screw 35, to apply a force to the detector unit 12 (13) to be separated from the side plate 25. By use of the hexagon socket setscrew 36, the detector unit 12 (13) is prevented from returning to the tilted state in FIG. 17.

Figure 15:
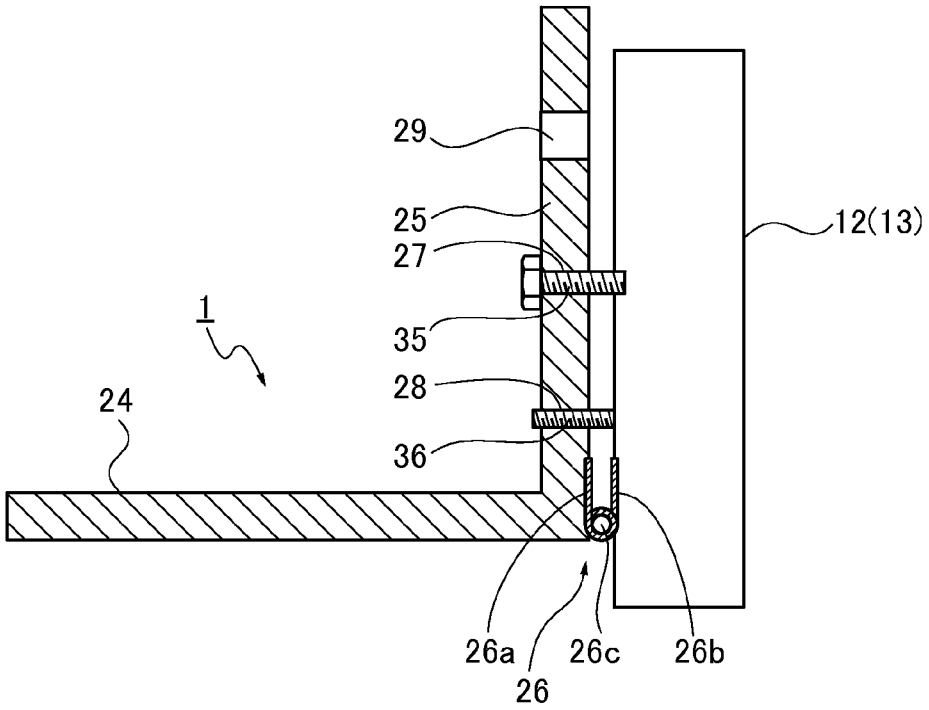
FIG. 15 is a side view of the inkjet head array and detector unit in FIG. 1 after the tilt adjustment is completed.

As a result, the posture of the detector unit 12 can be constantly maintained even if the blade spring 30 and the micrometer 32 are removed from the side plate 25, as shown in FIG. 15.

Thus, the tilt adjustment of the inkjet head array 1 and the detector unit 12 is completed. The tilt of the detector unit 13 is adjusted in the same manner.

The angle $\alpha$ of the laser diode 14*a* extends in a large distance in the direction Z2. Because of this, a slight change in the angle $\alpha$ largely changes the position at which the light beam P1 is received in the direction Y.

Meanwhile, the positions of the photodiodes 16*a*, 16*b* placed adjacent to the rotational shaft 26*c* are not changed in the direction Y even after the tilt of the detector unit 12 (13) is adjusted. Therefore, there will be almost no difference in the adjustment accuracy for the detector units 12, 13 although the detector units 12, 13 are separately adjusted.

Alternatively, a different tilt adjusting mechanism such as a goniometer stage can be incorporated in the inkjet recording device, however, it leads to enlarging the inkjet recording device. By use of the tilt adjusting mechanism according to the present embodiment, it is able to easily adjust the tilt of the laser diodes 14*a*, 14*b*.

Further, the tilt adjusting mechanism according to the present embodiment can be compact in size and requires a smaller space since it can join the inkjet head array and the detector unit 12 (13) with the hinge 26, drawing screw 35, and hexagon socket setscrew 36 alone, as shown in FIG. 15. Also, it can be manufactured at low cost.

Next, the relation between the optical axis of the light emitting element and the nozzle arrangement is described.

The optical axis of the light emitting element 14 or 15 is inclined relative to the direction L1 in which the nozzles a1*m* are arranged.

Figure 4A:
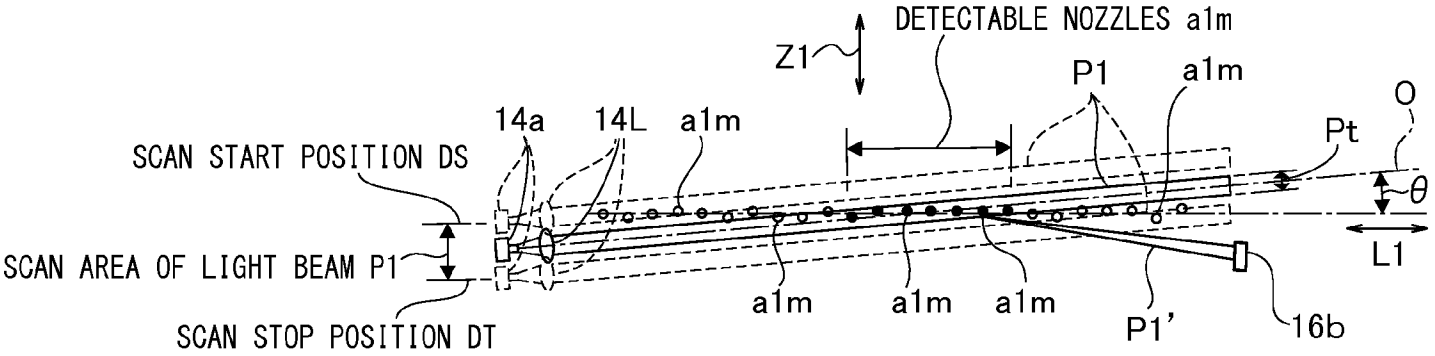
FIG. 4A shows that the number of nozzles detectable is small when the optical axis of the light emitting element of FIG. 2 is inclined at a large angle relative to the nozzle arrangement and FIG. 4B shows that the number of nozzles detectable is large when the optical axis of the light emitting element is inclined at a smaller angle than that in FIG. 4A relative to the nozzle arrangement.
Figure 4B:
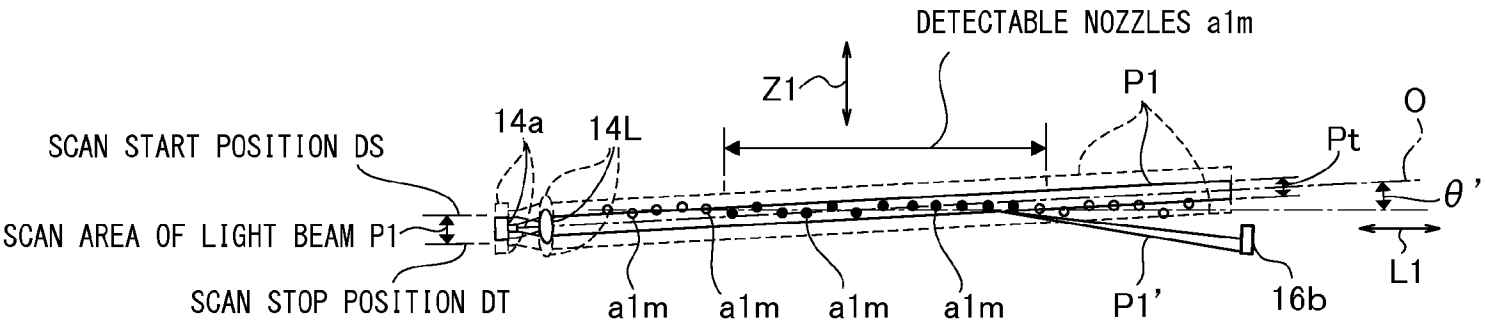

FIGS. 4A, 4B show an example of the relation between the optical axis of the light emitting element 14 and the direction L1, specifically, between the optical axis O of a collimator lens 14L of the laser diode 14*a* and the direction L1. The optical axis O makes an angle $\theta$ with the direction L1. Herein, the first nozzle line in the paper conveying direction Z1 is described.

The laser diode 14*a* is moved between a scan start position DS and a scan stop position DT in the paper conveying direction Z1, and its position is indicated by the solid line in the drawings. The light beam P1 has a detection width Pt in which the nozzles a1*m* or liquid droplets are detected.

Herein, the detection width Pt refers to an effective width within which presence of a liquid droplet or a nozzles a1*m* is detectable at any position by receiving the scattered light P1' from the liquid droplet in question.

If liquid droplets represented by the black circles are present in the detection width Pt, the photodiodes 16*a*, 16*b* properly receive the scattered light P1' indicating the presence of the liquid droplets.

Assumed that the detection width Pt of the light beam P1 is narrowed and the laser diode 14*a* is moved by the detection width Pt for detecting liquid droplets from all of the nozzles a1*m*. With a large angle $\theta$ as shown in FIG. 4A, the number of liquid droplets in the detection width Pt is decreased.

This increases the area in which the laser diode 14*a* is moved. Accordingly, it takes a longer time to detect liquid droplets in the direction L1 by a single movement of the laser diode 14*a*.

Meanwhile, in FIG. 4B the angle $\theta'$ between the optical axis O and the direction L1 is smaller than the angle $\theta$ in FIG. 4A and the number of liquid droplets in the detection width Pt is increased.

Thus, the area in which the light emitting element 14 is moved or the light beam P1 is reciprocated is narrowed. Accordingly, it is possible to shorten the time for detecting liquid droplets in the direction L1 by a single movement of the laser diode 14*a*.

At a narrower detection width Pt of the light beam P1, an error in the positions of the liquid droplets is relatively enlarged because of errors in the nozzle arrangement, mounted inkjet heads on the inkjet head array 1, and the direction in which liquid droplets are discharged.

Figure 5A:
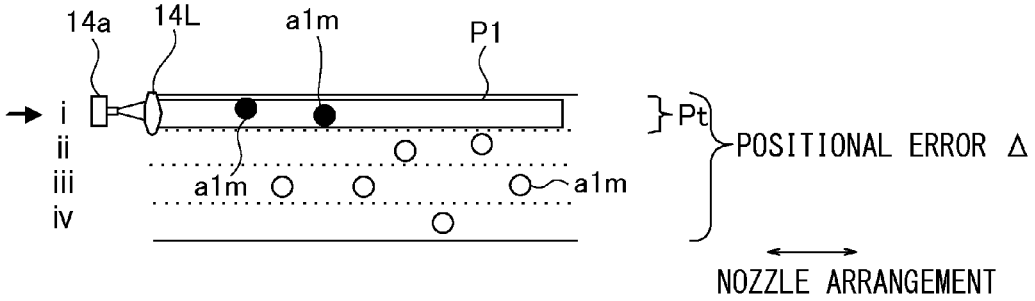
FIGS. 5A to 5D show a relation between an error in nozzle position in arrangement direction and the detection width of a light beam and detectable nozzles at scan positions i, ii, iii, iv, respectively.
Figure 5B:
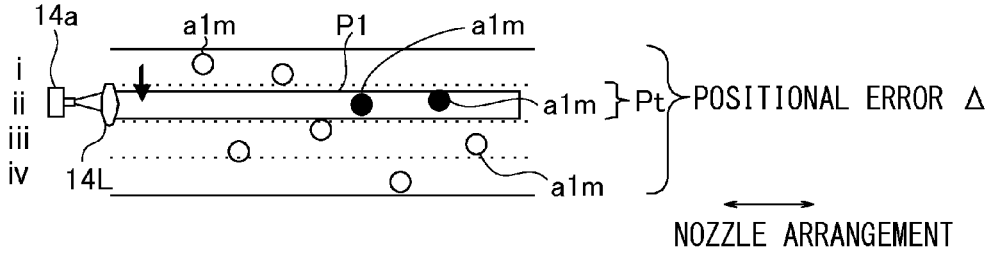
Figure 5C:
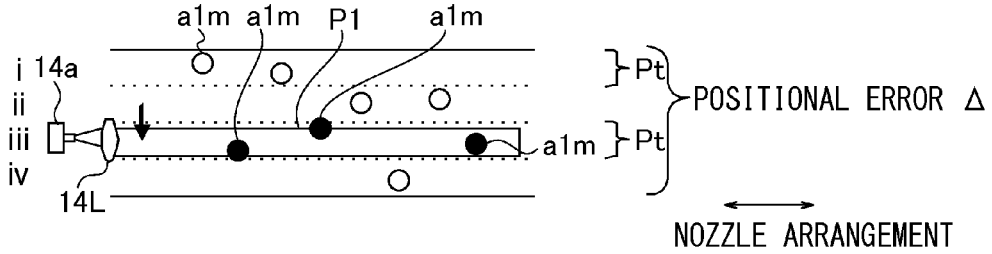
Figure 5D:
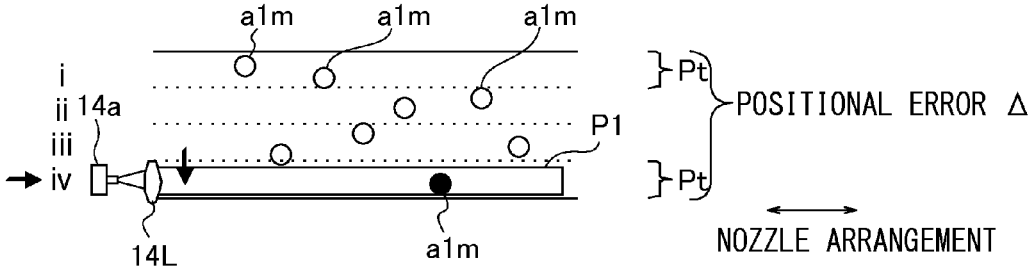

FIGS. 5A to 5B show, with exaggeration, dispersions in the positions of a line of the arranged nozzles a1*m* detectable by the scattered light P1' of the light beam P1 emitted from the laser diode 14*a* of the light emitting element 14 in FIG. 2.

The laser diodes 14*a*, 14*b* are each used to detect the two nozzle lines, as described above. The light emitting element 14 detects the four nozzle lines of the inkjet head 1*a*1.

Likewise, the light emitting element 15 detects the four nozzle lines of the inkjet head 1*a*2. In the following the laser diode 14*a* and one nozzle line detected by the corresponding photodiodes 16*a*, 16*b* are described.

Assumed that the angle $\theta'$ in FIG. 4 is 0 degree. An error in the positions of liquid droplets from the nozzles a1*m* relative to the direction L1 is defined to be $\Delta$. The error $\Delta$ is larger than the detection width Pt of the light beam P1. The number of liquid droplets or nozzles a1*m* detectable in one detection width Pt is limited accordingly.

In view of this, a scan step number of the light beam P1 of the laser diode 14*a* is defined to be a value obtained by dividing the positional error Δ of the liquid droplets by the detection width Pt. That is, the scan step number is Δ/Pt. As shown in FIGS. 5A to 5D, all the liquid droplets or nozzles a1*m* in the direction L1 can be detected irrespective of the positional error Δ by moving the light beam P1 by one scan step.

FIGS. 5A to 5D show the nozzles a1*m* (represented by the black circles) detectable by one scan step of the light beam P1. The photodiodes 16*a*, 16*b* receive the scattered light P1' from the liquid droplets discharged from the nozzles a1*m*. The detector units 12, 13 in FIG. 2 can thus determine if liquid droplets are discharged from the nozzles a1*m* by detecting the scattered light P1'.

The controller 20 is connected to a storage 23 in FIG. 2. The storage 23 stores, according to an instruction from the controller 20, various kinds of information including the initial positions and the moving positions of the light emitting element 14 and light receiving element 16, the area (corresponding to the positional error Δ of the nozzles a1*m*) in which liquid droplets are detectable by moving the light emitting element 14, and correspondence information on the position of the light emitting element 14 and a nozzle a1*m* associated with a detected liquid droplet.

Figure 6:
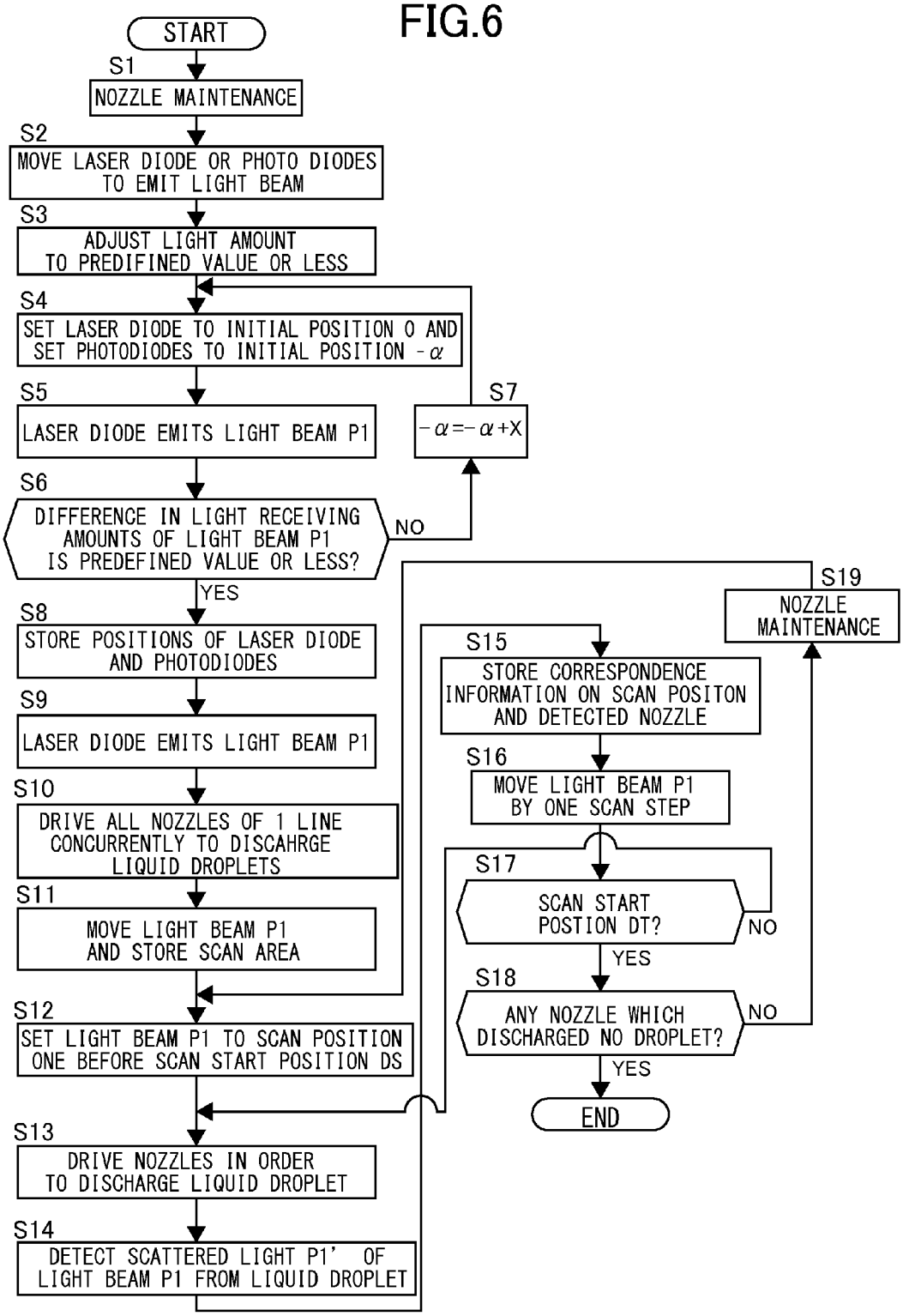
FIG. 6 is a flowchart for the operation of the liquid droplet detecting device, showing how to obtain correspondence information on a light beam and nozzles when a tilt of a detector unit relative to an inkjet head array is adjusted.

Next, maintenance work before shipment including the tilt adjustment of the detector unit 12 (13) relative to the inkjet head array 1 is described, referring to FIG. 6.

In step S1 the controller 20 allows all the nozzles a1*m* in the direction L1 to discharge liquid droplets for maintenance.

Figure 21:
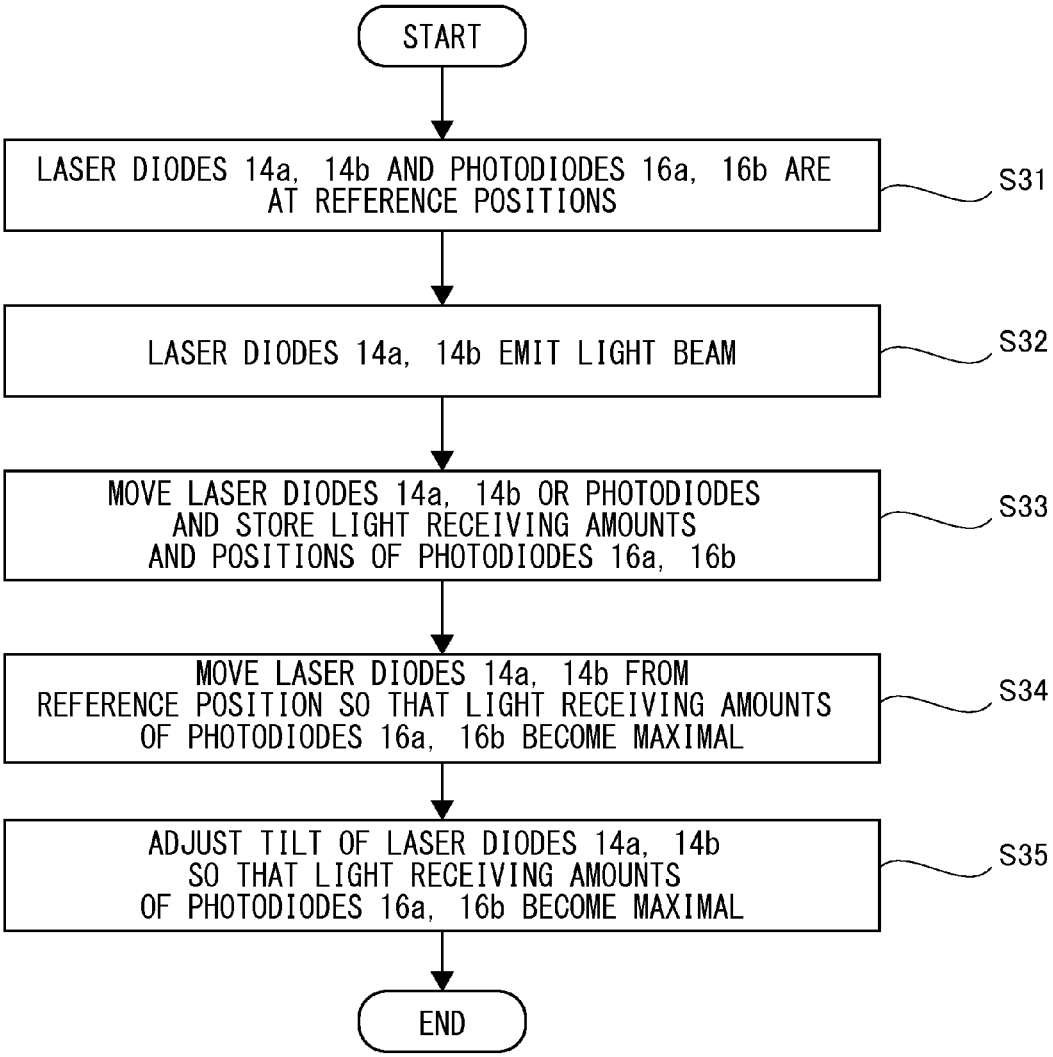
FIG. 21 is a flowchart for adjusting a tilt of the detector unit in FIG. 13 to FIG. 20 by a tilt adjusting mechanism.

In step S2 the controller 20 moves the laser diodes 14*a*, 14*b* to the positions of the laser diodes 14*a*, 14*b* or the photodiodes 16*a* to 16*c* stored in the storage at the time of the tilt adjustment of the detector unit 12 (13) in FIG. 21, to emit light beams.

In step S3 the controller 20 allows the photodiodes 16*a*, 16*b* to detect direct light of the light beams and adjusts the output of the light beams so that the amount of the direct light is a predefined value or less.

In step S4 the laser diode 14*a* is set to the reference position (initial position or position 0) and the photodiodes 16*a*, 16*b* are set to the reference position (initial position or position −α).

Note that the initial position or position 0 of the light emitting element 14 and the initial position or position −α of the light receiving element are detected by respective position sensors (not shown). The position sensors can be provided in arbitrary positions for acquiring their positions relative to an arbitrary reference position of the light emitting element 14, when needed.

Since forward scattering is applied in the present embodiment, a determination is made on whether or not a difference in the outputs (amounts of received light beam P1 or offset light amounts) of the photodiodes 16*a*, 16*b* is below or equal to a predefined value.

In step S5 the controller 20 allows the laser diode 14*a* to emit the light beam P1. The photodiodes 16*a*, 16*b* then receive the light beam P1. In step S6 the controller 20 determines whether or not the outputs (amount of received light beam P1) of the photodiodes 16*a*, 16*b* fall below or equal to a predefined value.

When a difference between the light-receiving amounts of the photodiodes 16*a*, 16*b* is not equal to or below the predefined value, the controller 20 moves the photodiodes 16*a*, 16*b* towards the optical axis O of the laser diode 14*a* by an amount x in step S7. The amount x is defined to be a moving amount of the light receiving element 16 and it is about 5 nm to 20 nm.

The operations in steps S4 to S7 are repeated (NO in step S6) until the difference in the light-receiving amounts of the photodiodes 16*a*, 16*b* falls below or equal to the predefined value.

With YES in step S6, the controller 20 stores the positions of the laser diode 14*a* and photodiodes 16*a*, 16*b* in the storage 23 in step S8. Thereby, the light receiving element is properly set relative to the optical axis of the light emitting element.

In step S9 the controller 20 drives the laser diode 14*a* to emit the light beam P1, and controls all the nozzles of one line in the direction L1 to discharge liquid droplets in step S10.

The photodiodes 16*a*, 16*b* detect the amount of the scattered light P1' from the liquid droplets. In step S11 the controller 20 moves the laser diode 14*a* concurrently with the light emission and stores a scan area from the scan start position DS to the scan stop position DT in the storage 23.

In step S12 the controller 20 sets the laser diode 14*a* and photodiodes 16*a*, 16*b* to a scan position one before the scan start position DS.

In step S13 the controller 20 drives the nozzles a1*m* of the first line in order. For example, the $1^{st}$ to $12{,}600^{th}$ nozzles a1*m* counted from the laser diode 14*a* in FIGS. 4A, 4B are driven in order to discharge liquid droplets.

In step S14 the photodiodes 17*a*, 17*b* of the light receiving element 17 detect the light amount of the scattered light P1' by the liquid droplet. In step S15 correspondence information on the scan position of the light beam P1 and the positions of the detected nozzles a1*m* is stored in the storage 23.

In step S16 the light beam P1 is moved by one scan step. In step S17 the controller 20 determines whether or not the laser diode 14*a* and photodiodes 16*a*, 16*b* are synchronously moved to the scan stop position DT.

When they are not moved to the scan stop position DT, the operations in steps S13 to S16 are repeated. That is, a determination is made on whether or not the light beam P1 is reciprocated from the scan positions i to iv in FIGS. 5A to 5B in the paper conveying direction.

For example, 12,600 nozzles a1*m* from the light emitting element 14 side are driven in order at the scan position i in FIG. 5. With no discharge failure, the numbers of the $1^{st}$ and $3^{rd}$ nozzles a1*m* relative to the scan position i are stored as correspondence information in the storage 23.

For another example, 12,600 nozzles a1*m* from the light emitting element 14 side are driven in order at the scan position ii in FIG. 5. With no discharge failure, the numbers of the $5^{th}$ and $7^{th}$ nozzles a1*m* relative to the scan position ii are stored as correspondence information in the storage 23.

For another example, at the scan position iii, the numbers of the $2^{nd}$, $4^{th}$, $8^{th}$ nozzles a1*m* relative to the scan position iii are stored as correspondence information in the storage 23. For another example, at the scan position iv, the number of the $6^{th}$ nozzle a1*m* relative to the scan position iv is stored as correspondence information in the storage 23.

In step S18 a determination is made on whether or not the liquid droplets have been discharged from all the nozzles a1*m* of the first line, that is, whether or not there is any nozzle a1*m* having discharged no liquid droplet. The known designed number of nozzles a1*m* and the number of detected nozzles are compared for this determination.

If the number of detected nozzles a1*m* is smaller than the known designed number, the flow proceeds to step S19 and the nozzles are subjected to maintenance work. Thereafter, steps S12 to S18 are repeated again. When the number of detected nozzles a1*m* matches the known designed number in step S18, the flow is completed.

By repeating step S12 to S18, correspondence information on all the nozzles a1*m* and the scan positions of the light beam P1 is stored in the storage 23 before shipment of the inkjet recording device. Likewise, correspondence information on the nozzles a2*m* of the inkjet head 1*a*2 and the scan positions of the light beam P1 of the light emitting element 15 is stored in the storage 23.

Next, an inspection of nozzles for discharge failure for maintenance of the inkjet recording device after shipment is described. The inkjet recording device is configured to perform maintenance in a certain cycle.

Figure 7:
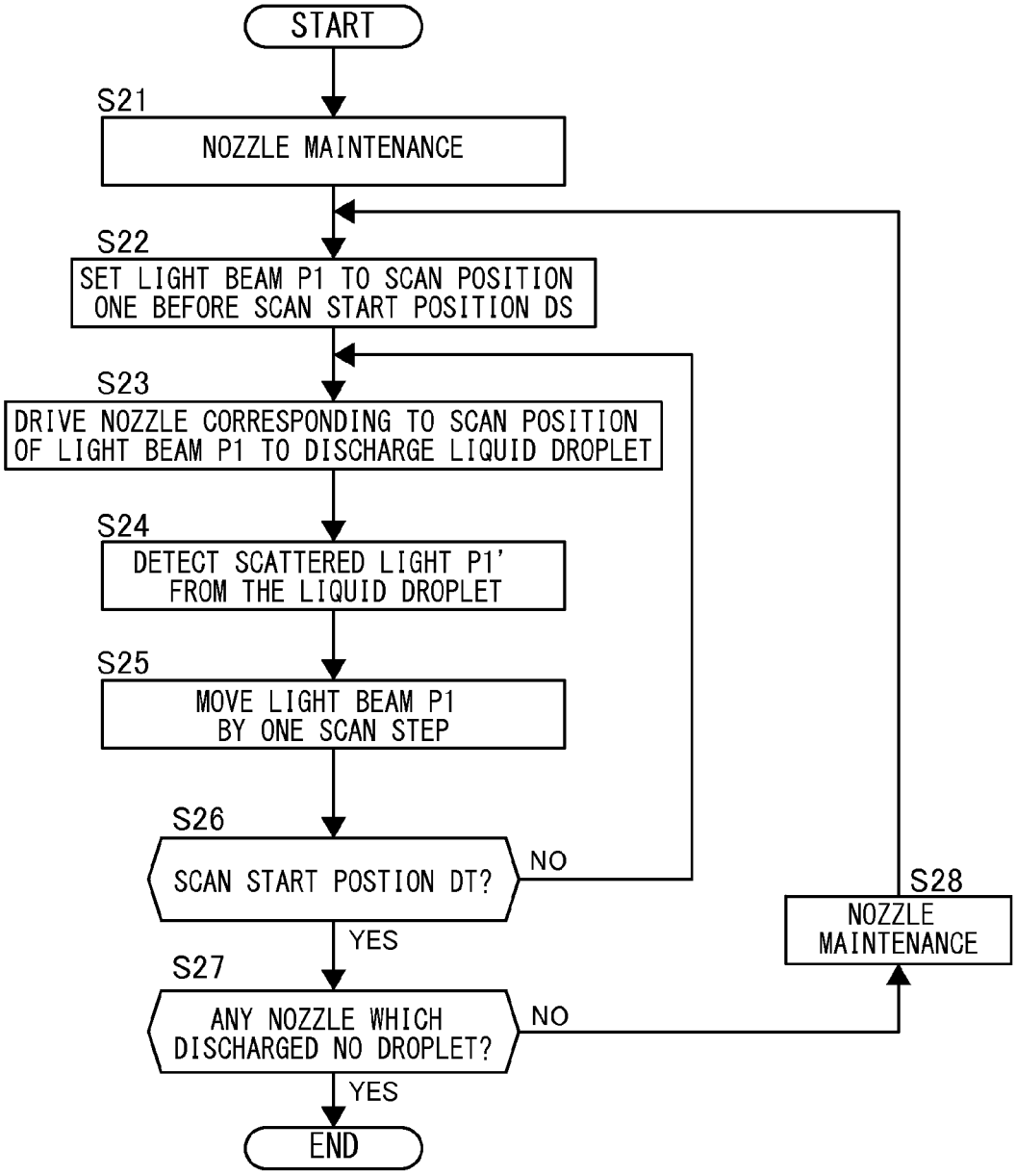
FIG. 7 is a flowchart for detecting a discharge failure of a nozzle according to the correspondence information obtained in FIG. 6.

For the sake of simple description, only one of the nozzle lines detected by the laser diode 14*a* is inspected and the other three nozzle lines are assumed to wait for inspection. Referring to FIG. 7, in step S21 the controller 20 instructs the laser diode 14*a* to emit the light beam P1.

In step S22 the controller 20 moves the light beam to a scan position one before the scan start position DS in accordance with information in the storage 23. In step S23 the nozzles a1*m* corresponding to the scan position are driven in order on the basis of the correspondence information on the nozzles a1*m* of the first line in the storage 23 to discharge liquid droplets.

The photodiodes 16*a*, 16*b* receive the scattered light P1' by the liquid droplets from the nozzles a1*m* at the scan position and the detector unit 13 determines presence or absence of the liquid droplets from the amount of the scattered light P1' in step S24. The controller 20 then moves the light beam P1 by one scan step in step S25. In step S26 the controller 20 determines whether or not the light beam P1 is moved to the scan stop position DT.

If the light beam P1 has not reached the scan stop position DT, the operations in steps S23 to S25 are repeated. Thereby, the number of detected nozzles a1*m* is counted and a determination is made on whether or not the number of detected nozzles matches the known designed number.

In step S27 a determination is made on whether or not there is any nozzle a1*m* having discharged no liquid drop. With a nozzle found, maintenance work is performed again in step S28 and the operations in steps S22 to S27 are repeated.

Figure 8:
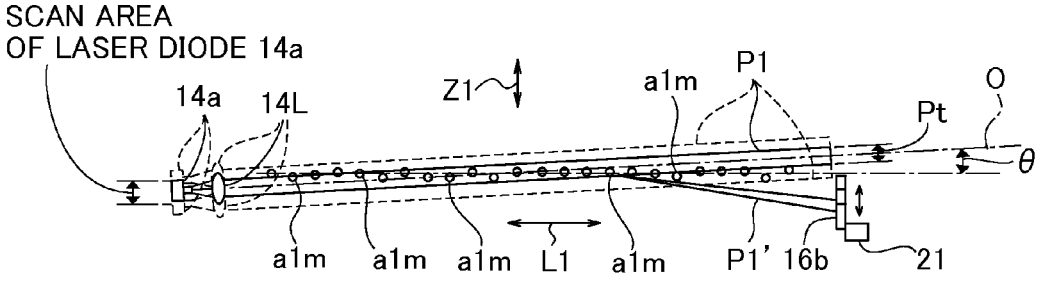
FIG. 8 shows a light emitting element reciprocated in a paper conveying direction to scan nozzles with a light beam.
Figure 9:
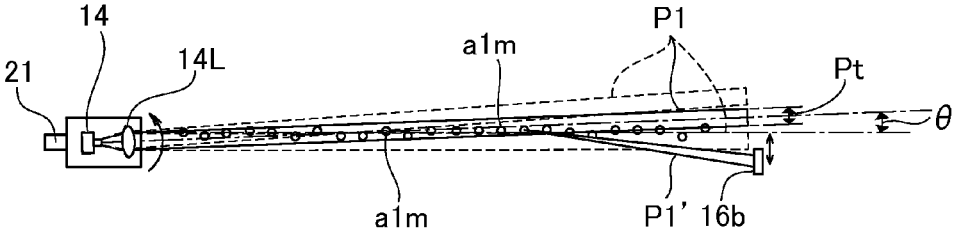
FIG. 9 shows a light emitting element scanning nozzles with a light beam while its optical axis is rotated.

Alternatively, the laser diode 14*a* and the photodiode 16*b* can be configured to be movable along with the conveyance of the paper W in sub-scanning direction, as shown in FIG. 8. Thereby, it is possible to properly detect the receiving of the scattered light P1'. Also, the light emitting element 14 can be rotatably provided and the light receiving element 16 can be fixed, as shown in FIG. 9.

The above embodiment has described an example where the offset light of the scattered light P1' is received by the pair of photodiodes to determine presence or absence of a liquid droplet according to a difference in the offset light amounts.

The present invention should not be limited to such an example. Alternatively, presence or absence of liquid droplet can be determined by directly receiving the peak of the light beam P1 with a Gaussian distribution and detecting a change in light receiving amount, for example.

Further, the scan step number is defined to be a value obtained by dividing the error Δ by the detection width P. Alternatively, the light beam P1 can be moved by a smaller amount than the detection width Pt in the paper conveying direction for liquid droplet detection.

Thus, the method for liquid droplet detection according to the present embodiment comprises pre-storing correspondence information on each of nozzles a1*m* arranged in the paper width direction Z2 orthogonal to the paper conveying direction Z1 and a scan position of the light beam P1, driving a nozzle in question at the scan position of the light beam according to the correspondence information to discharge a liquid droplet, and determining whether or not the liquid droplet is discharged from the driven nozzle a1*m* by receiving scattered light P1' by the discharged liquid droplet.

Further, the pre-storing includes confirming discharge of liquid droplets from all the nozzles a1*m* arranged, driving all the nozzles a1*m* arranged in the direction L1 to discharge liquid droplets and moving the light beam P1 from a reference position in the paper conveying direction Z1, receiving scattered light P1' by the liquid droplets discharged from the nozzles a1*m* to detect a scan area of the light beam P1, and storing a scan start position DS and a scan stop position DT. The determining includes receiving the scattered light P1' by the light beam P1 scanning from the scan start position DS to the scan stop position DT to determine whether or not the liquid droplet is discharged from each of the nozzles a1*m*.

According to the present embodiment the relations between the scan positions of the light beam P1 and the nozzles are pre-stored. Also, the scan area of the light beam P1 is predefined, therefore, it is possible to determine, in the detection width Pt of the light beam P1, presence or absence of a liquid droplet discharged from each of the large number of the nozzles. Thus, it is able to quickly, reliably determine a nozzle with a discharge failure by driving the nozzles at the scan positions to determine presence or absence of a liquid droplet.

Thus, it is made possible to rapidly inspect the nozzles for a discharge failure irrespective of the mount accuracy of the inkjet heads 1*a*1, 1*a*2 in the inkjet recording device and the mount accuracy and adjustment accuracy of the detector units 12, 13.

Further, for replacing an ink head module for maintenance, it is able to perform discharge failure inspection after maintenance work with no use of a large jig.

According to the above embodiments, it is made possible to quickly and accurately detect presence or absence of liquid droplets discharged from the nozzles.

It is possible to eliminate an error in the direction in which liquid droplets are discharged by setting the scan step number and starting the detection at the scan position one before the scan start position DS. Thereby, the nozzles having discharged liquid droplets can be detected without fail. It is preferable to set the moving amount of the light beam P1 to be slightly smaller than the detection width Pt of the light beam P1 in view of eliminating the error in the discharge direction.

Figure 10:
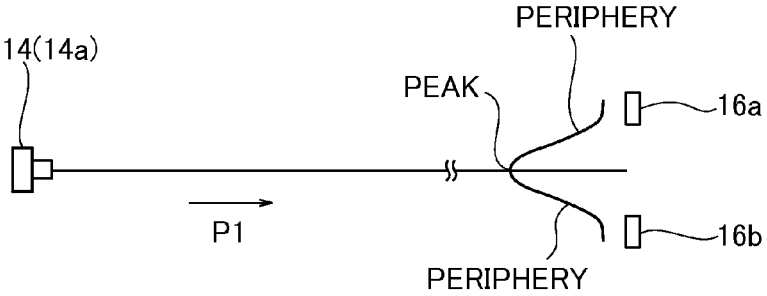
FIG. 10 shows offset light of a light beam.

Note that in the scattered light receiving, the offset light by the light beam P1 refers to a peripheral portion of the peak of the light beam P1 with a Gaussian distribution as shown in FIG. 10.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A liquid droplet detecting device comprising:

nozzles arranged in a paper width direction orthogonal to a paper conveying direction to discharge liquid droplets;

a light emitting element provided on one side of the paper width direction to emit a light beam for liquid droplet detection;

a light receiving element provided on the other side of the paper width direction to receive the light beam;

a storage in which correspondence information on each of the nozzles and a scan position of the light beam when discharge of a liquid droplet from each of the nozzles is detected is stored;

a controller to allow the light beam to scan according to the correspondence information; and a detector to determine presence or absence a liquid droplet discharged from each nozzle from an output of the light receiving element;

wherein the light beam is scanned in the paper conveying direction;

wherein the light receiving element is reciprocated in the paper conveying direction in synchronization with a moving of the light emitting element.

2. The liquid droplet detecting device according to claim 1, wherein a moving amount of the light beam is smaller than a detection width of the light beam.

3. The liquid droplet detecting device according to claim 2, further comprising:

a first position sensor for detecting a reference position of the light emitting element; and a second position sensor for detecting a reference position of the light receiving element, wherein:

the light receiving element is configured to receive a pair of offset light beams of the light beam from the light emitting element at the reference position; and the controller is configured to determine whether or not a difference between amounts of the pair of offset light beams is a predefined value or less and determine that the light receiving element is properly set relative to an optical axis of the light emitting element when the difference is the predefined value or less.

4. The liquid droplet detecting device according to claim 1, further comprising:

a first position sensor for detecting a reference position of the light emitting element; and a second position sensor for detecting a reference position of the light receiving element, wherein:

the light receiving element is configured to receive a pair of direct light beams of the light beam from the light emitting element;

the controller is configured to move the light emitting element or the light receiving element in the paper conveying direction to a position in which an output of the light receiving element by the pair of direct light beams becomes maximal, and store the position of the light emitting element or light receiving element in the storage.

5. The liquid droplet detecting device according to claim 4, wherein a tilt of the light beam is adjusted in the positions of the light emitting element and the light receiving element in which the output of the light receiving element by the pair of direct light beams becomes maximal.

6. The liquid droplet detecting device according to claim 5, wherein the output of the light emitting element is adjusted in the position in which the output of the light receiving element by the pair of direct light beams becomes maximal, to have the output of the light receiving element be a predefined value or less.

7. An inkjet recording device comprising the liquid droplet detecting device according to claim 1.

8. A liquid droplet detection method, comprising:

pre-storing correspondence information on each of nozzles arranged in a paper width direction orthogonal to a paper conveying direction and a scan position of a light beam;

driving a nozzle in question to discharge a liquid droplet at the scan position of the light beam according to the correspondence information; and determining whether or not the liquid droplet is discharged from the driven nozzle by receiving scattered light by the discharged liquid droplet;

the pre-storing includes confirming that liquid droplets are discharged from all the nozzles, driving all the nozzles to discharge liquid droplets and moving the light beam from a reference position in the paper conveying direction, receiving scattered light by the liquid droplets discharged from the nozzles to detect a scan area of the light beam, and storing a scan start position and a scan stop position; and the determining includes receiving the scattered light by the light beam scanning from the scan start position to the scan stop position to determine whether or not the liquid droplet is discharged from each of the nozzles.

9. The liquid droplet detection method according to claim 8, further comprising:

setting a value obtained by dividing the scan area of the light beam by the detection width as a scan step number; and starting the droplet discharge detection from a scan position one before the scan start position.

* * * * *